United States Patent [19]

Inaba et al.

[11] Patent Number: 4,608,570

[45] Date of Patent: Aug. 26, 1986

[54] AUTOMOTIVE WINDOW GLASS ANTENNA

[75] Inventors: Hiroshi Inaba; Kazuya Nishikawa, both of Mie, Japan

[73] Assignee: Central Glass Company, Limited, Yamaguchi, Japan

[21] Appl. No.: 548,799

[22] Filed: Nov. 4, 1983

[30] Foreign Application Priority Data

| | | | |
|---|---|---|---|
| Nov. 18, 1982 | [JP] | Japan | 57-201025 |
| Nov. 27, 1982 | [JP] | Japan | 57-206872 |
| Apr. 25, 1983 | [JP] | Japan | 58-71418 |
| May 14, 1983 | [JP] | Japan | 58-83515 |

[51] Int. Cl.[4] ..... H01Q 1/02; H01Q 1/32

[52] U.S. Cl. ..... 343/704; 343/713; 219/203

[58] Field of Search ..... 343/713, 704, 711, 712; 219/203, 522

[56] References Cited

U.S. PATENT DOCUMENTS

| | | | |
|---|---|---|---|
| 4,063,247 | 12/1977 | Sakurai et al. | 343/713 |
| 4,260,989 | 4/1981 | Ishii et al. | 343/713 |
| 4,439,771 | 3/1984 | Kume et al. | 343/713 |
| 4,491,844 | 1/1985 | Tsuchie et al. | 343/713 |

FOREIGN PATENT DOCUMENTS

| | | | |
|---|---|---|---|
| 102903 | 8/1980 | Japan | 343/713 |
| 138903 | 10/1980 | Japan | 343/713 |
| 140301 | 11/1980 | Japan | 343/713 |

*Primary Examiner*—Eli Lieberman
*Assistant Examiner*—Michael C. Wimer
*Attorney, Agent, or Firm*—Pollock, Vande Sande and Priddy

[57] ABSTRACT

An automotive window glass antenna incorporating in a window glass a first antenna possessing a horizontal part and a vertical part to form a T-shape, a second antenna for phase compensation comprising at least one horizontal antenna wire disposed on one side of the vertical part of the first antenna and connected thereto, a third antenna for impedance matching disposed on the other side of the vertical part of the first antenna and connected thereto, and a feed point connected to the third antenna, said the second and the third antennas being asymmetric with respect to the vertical part of the first antenna.

14 Claims, 38 Drawing Figures

FIG. 3
PRIOR ART
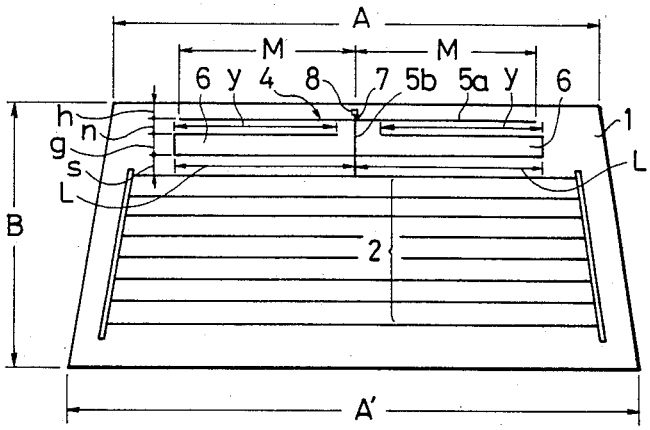
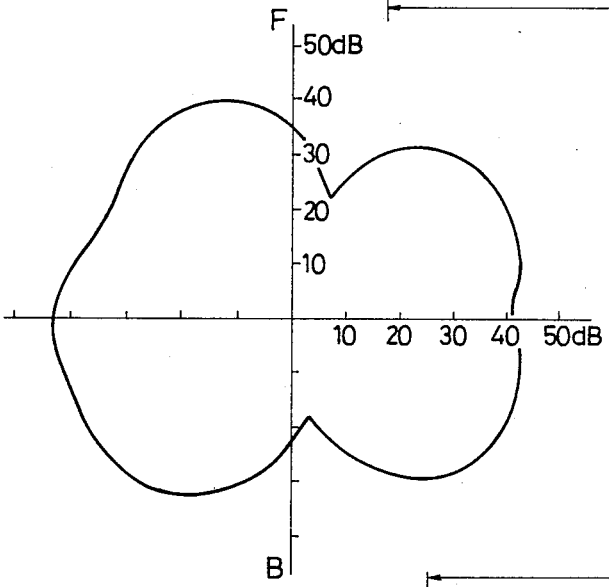
FIG. 4
PRIOR ART
FIG. 5
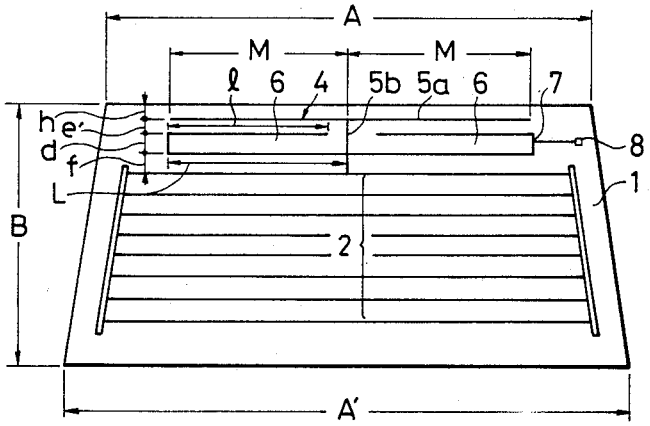

AUTOMOTIVE WINDOW GLASS ANTENNA

FIELD OF THE INVENTION

This invention relates to an automotive window glass antenna, and more particularly to an automotive window glass antenna which is set up on the window of an automobile and used advantageously for the reception of radio waves.

DESCRIPTION OF THE PRIOR ART

In recent years, automotive window glasses incorporation heat wires and antenna wires have come to find growing adoption. These automotive window glass antennas otherwise popularly called combination defogger-antennas adapted for use in an automobile are of two types.

The window glass antennas of the first type have heat wires and antenna wires independently disposed on the automotive windows and allow them to fulfil their functions separately. Those of the second type have heat wires and antenna wires connected to each other and cause the heat wires to function concurrently as auxiliary antenna wires.

FIG. 1 illustrates a conventional automotive window glass antenna of the first type. In this diagram, 1 denotes a window glass in an automobile and 2 a heater conductor disposed on the window glass 1. A receiving antenna 3 is disposed above and apart from the heater conductor 2 on the window glass 1.

The directional property this window glass exhibits when it receives FM radiobroadcasting waves is illustrated in FIG. 2. In the directional property diagram, F denotes the fore side of the automobile and B the hind side of the automobile and the radii represent the directions in which electric waves arrive at the antenna. The curve "a" represents the reception of FM waves at 80 MHz, the curve "b" that of FM waves at 83 MHz, and the curve "c" that of FM waves at 86 MHz respectively.

It is noted from FIG. 2 that the combination defogger-antenna adapted for use in an automobile of the first type displays the minimum reception gain to the electric waves arriving from the fore and hind sides of the automobile and the maximum reception gain to the electric waves arriving from the lateral sides thereof. The conventional automotive window glass antenna of the first type, accordingly, has a disadvantage that the difference between the minimum and maximum reception gains is fairly large as seen from the diagram and that it fails to obtain a high reception gain throughout the entire zone of frequency. Depending on the direction of the automobile, therefore, the drop of the reception gain may be so large as to render the reception of FM waves by the antenna totally ineffectual.

FIG. 3 illustrates an automobile window glass antenna of the second type already proposed by the inventors to the art. In the diagram, 1 denotes an automotive window glass and 2 a combination heater wire and receiving antenna disposed on the window glass 1. By 4 is denoted a T-shaped antenna possessing a horizontal part 5*a* and a vertical part 5*b*. To the vertical part of the T-shaped antenna is connected a receiving antenna 6 which is laterally symmetrical with respect to the vertical part 5*b* and has its open ends folded back over themselves. An intersection 7 formed by the horizontal part 5*a* and the vertical part 5*b* of the T-shaped antenna 4 is adapted as a feed point. Otherwise, a feed point 8 is formed on a conductor drawn out vertically from the intersection 7.

When this window glass antenna is formed in the dimensions, A=1,100 mm, A'=1,450 mm, B=590 mm, M=510 mm, L=530 mm, y=490 mm, S=30 mm, g=30 mm, n=30 mm, and h=40 mm and the heater wiring 2 is formed of a total of 13 heat wires spaced by intervals of 35 mm, the directional property which this antenna exhibits on receiving horizontally polarized radio waves at 80 MHz is as illustrated in FIG. 4.

From this diagram, it is noted that this window glass antenna is improved in terms of average gain but still leaves much to be desired in terms of directional property.

Thus, the conventional automotive window glass antennas have suffered from a disadvantage that when they are to receive FM radiobroadcasting waves at places where the directional property is strong or the field strength is weak, they may have gains which are too small to achieve effective reception of FM waves, depending on the direction of the automobile or the magnitude of the frequency.

SUMMARY OF THE INVENTION

An object of this invention is to provide an automobile window glass antenna which overcomes the aforementioned defects of the conventional art, exhibits a notably improved directional property throughout the entire frequency zone of FM radiobroadcasting waves, and therefore can advantageously be used for reception of FM broadcasts in Japan and other countries like the United States and Europe.

The automotive window glass antenna provided by this invention is characterized by having the isotropy and average gain thereof improved by comprising, in combination, a first antenna possessing a horizontal part and a vertical part to form a T-shape, a second antenna for phase compensation comprising at least one horizontal wire disposed on one side of the vertical part of the first antenna and connected thereto, a third antenna for impedance matching disposed on the other side of the vertical part of the first antenna and connected thereto, and a feed point connected to the third antenna, said the second and the third antennas being asymmetric with respect to the vertical part of the first antenna.

The automotive window glass antenna of this invention is further characterized by having the vertical part of the first antenna extended and connected to the heater wiring disposed on the window glass.

BRIEF DESCRIPTION OF THE DRAWINGS

FIG. 3 is a plan view of a conventional window glass antenna of the second type.

FIG. 4 is a diagram of the directional property which the conventional window glass antenna of FIG. 3 exhibits on receiving FM waves of 80 MHz.

FIG. 5 is a plan view of a window glass antenna which the inventors of this invention made temporarily for experimental purposes.

DETAILED DESCRIPTION OF THE INVENTION

Figure 6:
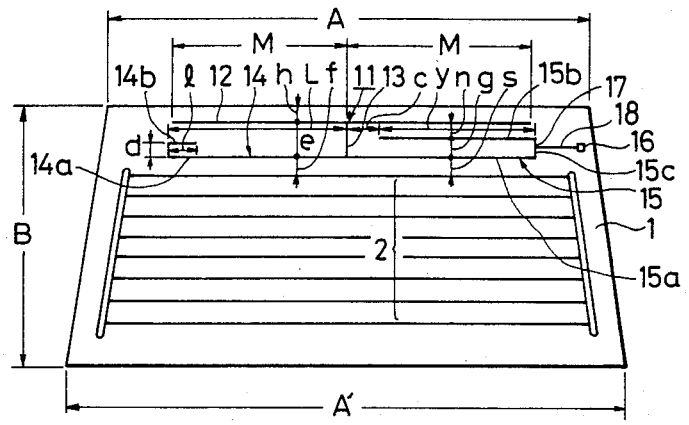
FIG. 6, FIG. 7 and FIG. 8 are plan views of window glass antennas representing the first, second, and third embodiments of this invention.

Now, the present invention will be described by reference to the drawings mentioned above. FIG. 6 illustrates the window glass antenna representing the first embodiment of this invention. It has an antenna pattern which is particularly suitable for the reception of FM broadcasts. In the diagram, 1 denotes a sheet glass forming a rear window glass or windshield of an automobile, for example, and 2 represents a heater wiring formed on the sheet glasss 1. By 11 is denoted a first antenna composed of a horizontal part 12 and a vertical part 13 to form a T-shape. Denoted by 14 is a second antenna which is composed of a horizontal part 14*a* and a folded part 14*b*. And by 15 is denoted a third antenna composed of a horizontal part 15*a* and a folded part 15*b*. A point 17 from which a feed point 16 issues is formed in a vertical part 15*c* connecting the horizontal part 15*a* of the third antenna 15 and the folded part 15*b* thereof. The point 17 is connected by a conductor 18 to the feed point 16. The first, the second and the third antennas are disposed above the heater wiring 2 on the sheet glass 1.

Figure 7:
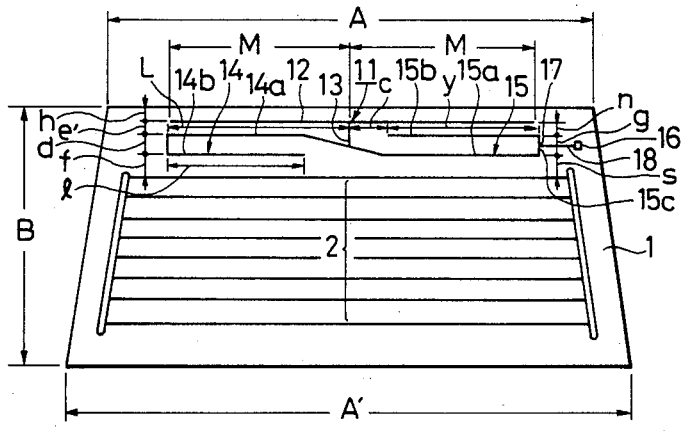
Figure 8:
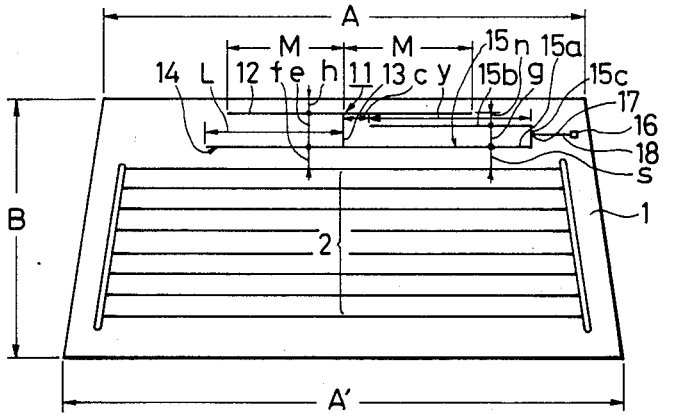

FIG. 7 illustrates the window glass antenna representing the second embodiment of this invention and FIG. 8 the window glass antenna representing the third embodiment of the invention. The same numerical symbols used in these diagrams as in FIG. 6 represent the same components as indicated in FIG. 6 (first embodiment).

The window glass antenna of the second embodiment is characterized by forming the second and third antennas 14, 15 in substantially identical shapes and making them asymmetric with respect to the vertical part of the first antenna by connecting the horizontal part 14*a* of the second antenna by an oblique wire to the horizontal part 15*a* of the third antenna. The window glass antenna of the third embodiment is characterized by having the second antenna 14 thereof formed solely of a horizontal part and omitting the folded part 14*b* used in the window glass antenna of the first embodiment.

When the automotive window glass antenna of this embodiment receives FM radiobroadcasting waves, the first antenna 11 functions as a main antenna. The second antenna 14 possessing at least one horizontal part extended in the horizontal direction and disposed on one side of the vertical part 13 of the first antenna functions to eliminate possible phase differences between the direct waves and the waves reflected by the automobile body, the ground, buildings, human bodies, etc. and improves the directional property and, at the same time, enhances the average gain. The third antenna 15 possessing a horizontal part extended in the horizontal direction and disposed on the other side of the vertical part 13 of the first antenna and a folded part issuing from the end of the horizontal part fulfils the role of approximating the impedance of the antenna to the impedance (75 Ω) of the feeder wire (coaxial cable) and heightening the receiving sensitivity.

Figure 9:
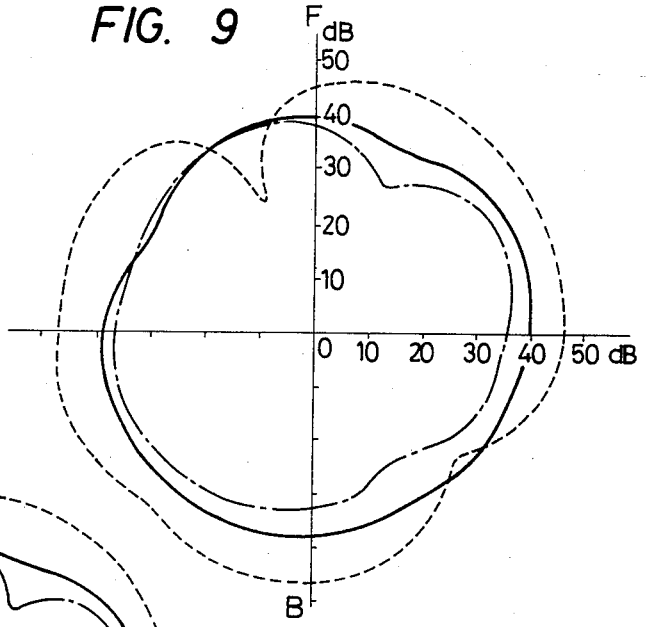
FIG. 9, FIG. 10, and FIG. 11 are diagrams of the directional property which the window glass antenna of the first embodiment mentioned above exhibits on receiving FM waves of 80 MHz, 83 MHz, and 86 MHz respectively.
Figure 10:
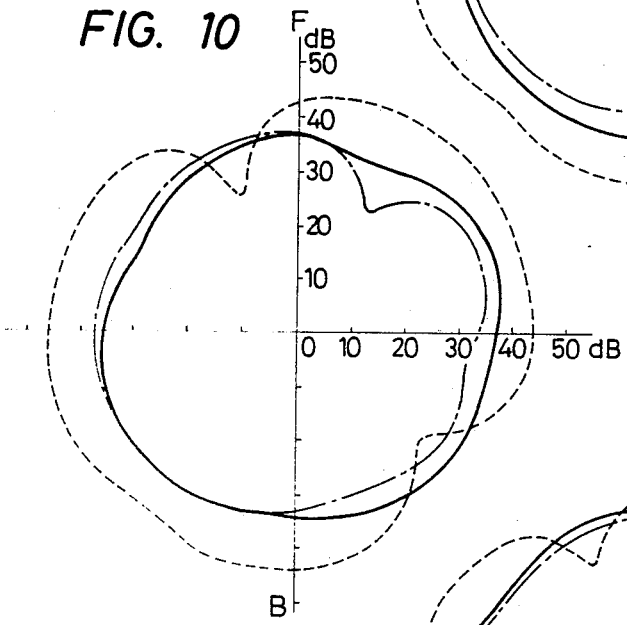
Figure 11:
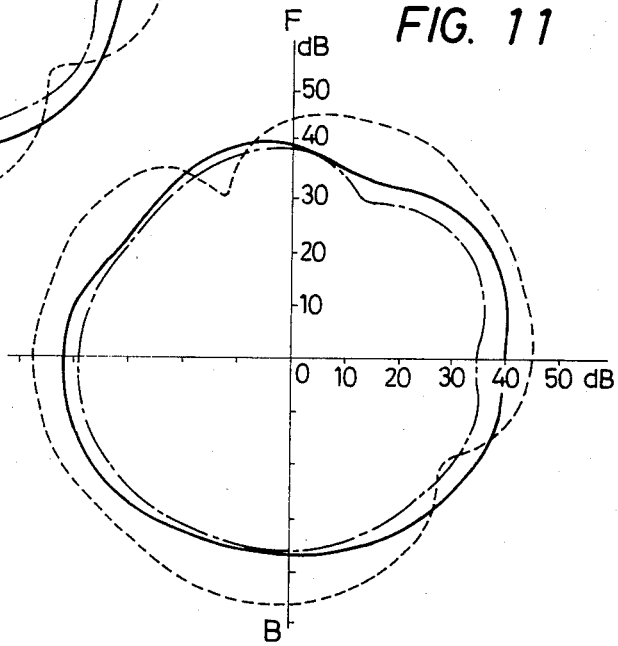

In the automotive window glass antenna of the first embodiment illustrated in FIG. 6, when the window glass 1 is formed in the dimensions, A=1,100 mm, A'=1,450 mm, B=590 mm, and the component parts of the antenna are formed in the dimensions, M=520 mm, L=550 mm, l=40 mm, D=10 mm, e=50 mm, f=25 mm, y=530 mm, s=25 mm, c=20 mm, g=25 mm, n=25 mm, and h=40 mm, the directional property exhibited by the antenna is as shown in FIG. 9, FIG. 10, and FIG. 11.

FIG. 9 represents the directional property of the FM zone at 80 HMz, FIG. 10 that at 83 MHz, and FIG. 11 that at 86 MHz respectively. In the diagrams, the solid line represents the directional property of the window glass antenna of the embodiment of FIG. 6, the dotted line that of a whip antenna 1 m in length, and the chain line that of the window glass antenna of FIG. 6 minus the second antenna 14. It is noted from the solid lines of FIG. 9, FIG. 10, and FIG. 11 that the window glass antenna of the first embodiment exhibits very high isotropy to waves arriving in all the directions. It is also noted that the reception gain obtained by the window glass antenna of the present embodiment is very close to that of the whip antenna.

Figure 1:
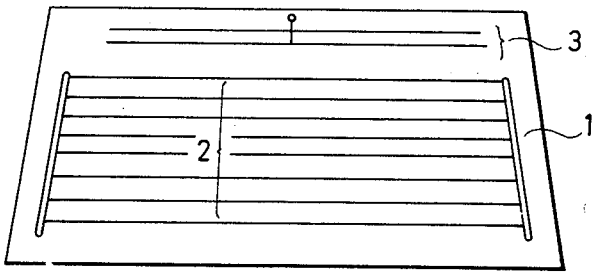
FIG. 1 PRIOR ART
FIG. 1 is a plan view of a conventional window glass antenna of the first type.
Figure 2:
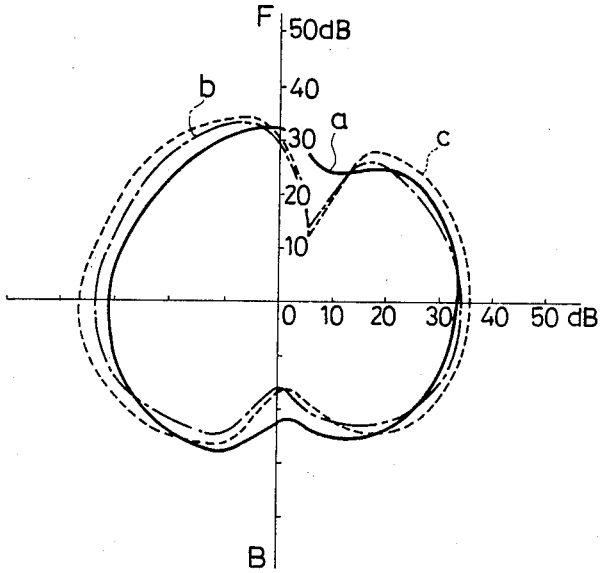
FIG. 2 PRIOR ART
FIG. 2 is a directional property diagram of the window glass antenna of FIG. 1.

The average gain obtained in the FM zone by the window glass antenna of the present embodiment, as expressed in terms of the gain difference based on the gain of the conventional window glass antenna of FIG. 1 taken as 0 dB, is +7.0 dB at 80 MHz, +5.2 dB at 83 MHz, and +6.4 dB at 86 MHz, averaging +6.2 dB. Even from this comparison, the notable improvement in the gain enjoyed by the window glass antenna of the present embodiment is evident.

When the window glass antenna of the first embodiment minus the T-shape of the first antenna 11, namely a window glass antenna composed only of the second antenna 14 and the third antenna 15, is tested for average gain of horizontally polarized waves in the FM zone, the average gain as expressed in terms of the gain difference based on the gain of the window glass antenna of the first embodiment of FIG. 6 taken as 0 dB is −10.3 dB at 80 MHz, −4.9 dB at 83 MHz, and −4.8 dB at 86 MHz, averaging −6.7 dB. The results indicate that the first antenna contributes very much to the improvement in the gain and functions as a main antenna.

In the case of a window glass antenna of the first embodiment minus the second antenna 14, namely a window glass antenna composed only of the first antenna 11 and the third antenna 15, the average gain similarly measured and expressed in terms of the gain difference based on the gain of the window glass antenna of the first embodiment taken as 0 dB is −2.6 dB at 80 MHz, −1.6 dB at 83 MHz, and −1.2 dB at 86 MHz respectively, averaging −1.6 dB. The results indicate that the second antenna 14 contributes to improving the gain. A review of the directional diagrams of FIG. 9, FIG. 10, and FIG. 11 reveals that the curves representing the window glass antenna lacking the second antenna 14 (chain lines) contain dips. The dips are thought to result from phase differences between direct waves and indirect waves or waves reflected by the ground, automobile body, etc. The results indicate that the second antenna 14 of the present invention functions to eliminate such dips and contributes to improving the directional property.

In the case of the window glass antenna of the first embodiment in which the third antenna 15 is replaced by one horizontal conductor and the power is fed through this conductor, the gain similarly measured and expressed in terms of the same gain difference as described above is −7.0 dB at 80 MHz, −8.2 dB at 83 MHz, and −3.4 dB at 86 MHz respectively, averaging −6.2 dB. The results indicate that the third antenna 15 contributes to improving the gain. In the case of the window glass antenna which includes the third antenna 15, the impedance measured at the feed point 16 (for comparison, the impedance measured in the window glass antenna lacking the third antenna 15, namely using a conductor instead, with the power fed solely through the conductor, is indicated in parentheses) is Rs (pure resistance component)=172 Ω (12 Ω) and Xs (reactance component; + being inductive and − capacitive)=+68 Ω (+141 Ω) at 80 MHz, Rs=54 Ω (504 Ω) and Xs=−40 Ω (−486 Ω) at 83 MHz, and Rs=56 Ω (133 Ω) and Xs=0 Ω (−241 Ω) respectively. As is well known, the pure resistance 75 Ω and the reactance |Xs| 0 Ω are ideal magnitudes for the window glass antenna. A review of the results of measurement described above reveals that when the window glass antenna includes the third antenna 15, the pure resistance Rs is near 75 Ω and the reactance |Xs| is close to 0 Ω as compared with the window glass antenna using the conductor in the place of the third antenna 15. It is, accordingly, clear that the third antenna 15 functions to match the impedance stably throughout the entire FM frequency zone and improves the overall properties of the antenna.

When the laterally symmetrized window glass antenna of FIG. 5, made temporarily for comparison with a window glass antenna of the present invention, is formed in the dimensions, M=520 mm, L=550 mm, l=530 mm, d=25 mm, f=25 mm, e'=25 mm, and h=40 mm, and the antenna wires and the heat wires are separated, the average gain of horizontally polarized waves in the FM zone similarly measured and expressed in terms of the gain difference based on the gain of the window glass antenna of FIG. 6 (first embodiment) taken as 0 dB is −3.4 dB at 80 MHz, −3.0 dB at 83 MHz, and −4.3 dB at 86 MHz respectively, averaging −3.6 dB. The results indicate that when the second and third antennas are laterally symmetrized, the gain is lowered and that, therefore, the second and third antennas disposed in a mutually asymmetrical relationship produce more desirable results.

In the window glass antenna of the second embodiment, when the components of the antenna illustrated in FIG. 7 are formed in the dimensions, A=1,100 mm, A'=1,450 mm, B=590 mm, M=540 mm, L=550 mm, l=y=530 mm, d=g=30 mm, e'=n=30 mm, f=s=30 mm, c=20 mm, H=40 mm, the average gain in the FM zone similarly measured and expressed in terms of the gain difference based on the gain of the window glass antenna of the first embodiment taken as 0 dB is −0.7 dB at 80 MHz, −0.5 dB at 83 MHz, and −0.3 dB at 86 MHz respectively, averaging −0.5 dB. The results indicate that the properties exhibited by the window glass antenna of the second embodiment are equal to those of the window glass antenna of the first embodiment.

In the window glass antenna of the third embodiment of this invention illustrated in FIG. 8, when the dimensions of the component parts (glass and antenna) are the same as those of the first embodiment except for L=530 mm, the average gain for the FM zone similarly measured and expressed in terms of the gain difference based on the gain of the window glass antenna of the first embodiment taken as 0 dB is −1.3 dB at 80 MHz, −1.0 dB at 83 MHz, and −1.2 dB at 86 MHz respectively, averaging −1.2 dB. The results indicate that the properties exhibited by the window glass antenna of the third embodiment are equal to those of the window glass antenna of the first embodiment.

The window glass antennas of the foregoing embodiments of this invention are fit for the reception of FM broadcasts of 76 MHz to 90 MHz in Japan and for the reception of FM broadcasts of 87.5 MHz to 108 MHz in the other countries like the United States and Europe as well.

In the case of the antenna pattern of FIG. 8 (third embodiment), for example, when the dimensions of the component parts (both glass and antenna) are equal to those of the window glass antenna of the first embodiment except for M=350 mm, the average gain for horizontally polarized waves in the FM zone similarly measured and expressed in terms of the gain difference based on the gain of the conventional window glass antenna of FIG. 1 taken as 0 dB is +4.5 dB at 90 MHz, +2.5 dB at 100 MHz, and +3.1 dB at 108 MHz respectively, averaging +3.4 dB. The results indicate that even in the frequency zone of 88 MHz to 108 MHz, the window glass antenna of the third embodiment enjoys improved properties as compared with the conventional window glass antenna.

In the same antenna pattern, when the component parts are formed in the dimensions, M=350 mm, L=530 mm, e=50, f=25 mm, y=530 mm, s=25 mm, c=20 mm, g=25 mm, and n=25 mm, the average gain for FM waves similarly measured and expressed in terms of the gain difference based on the gain of the rear whip antenna taken as 0 dB is −4.6 dB and 15.4 dB at 90 MHz, −3.4 dB and −15.3 dB at 100 MHz and +1.1 dB and −8.0 dB at 108 MHz respectively for horizontally polarized waves and vertically polarized waves, averaging −2.3 dB and −12.9 dB.

In consideration of the fact that the conventional window glass antenna of good quality shows average gains of about −5.7 dB and −20 dB respectively for horizontally polarized waves and vertically polarized waves, it is judged that the window glass antenna of the present embodiment exhibits very high average gains.

The window glass antennas of the first through third embodiments described above admit of the following alterations in antenna pattern.

Figure 12:
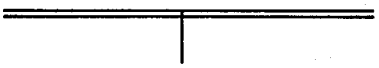
FIG. 12, FIG. 13, and FIG. 14 are plan views of modifications of the T-shaped first antenna.
Figure 13:
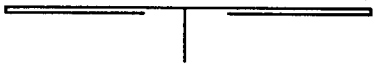
Figure 14:
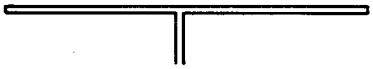

(1) In the first antenna, as illustrated in FIG. 12, FIG. 13, and FIG. 14, the horizontal part may be formed of two or more wires (FIG. 12), the end portions thereof may be folded back over themselves (FIG. 13), and the vertical part may be formed of two wires instead of just one wire so that the strokes of letter T will form a loop.

(2) As regards the folding of the end portions of the second antenna 14, it is more advantageous to omit the folding than otherwise where the magnitude of L represents a length of resonance for the reason to be given afterward. In the absence of this length of resonance, it is advantageous not to omit the folding.

(3) The horizontal parts 14*a*, 15*a* which are extended in the horizontal direction respectively in the second antenna 14 and the third antenna 15 may be formed into one straight line as in the first and third embodiments or they may be formed diagonally as in the second embodiment. It is also permissible that one be disposed at a higher level than the other.

Figure 15:
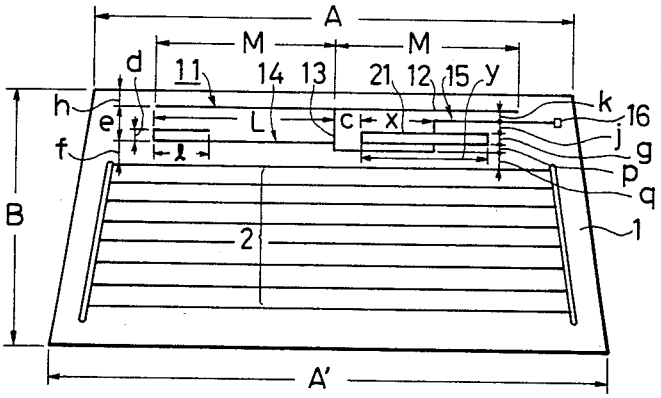
FIG. 15, FIG. 16, and FIG. 17 are plan views of window glass antennas representing the fourth, fifth, and sixth embodiments of this invention.

FIG. 15 illustrates a window glass antenna representing the fourth embodiment of the present invention. It has an antenna pattern which is particularly suited for the reception of horizontally polarized FM broadcasting waves.

In the diagram, 1 denotes a sheet glass destined to form a rear window glass or windshield of an automobile, for example, and 2 a heat wire disposed on the sheet glass 1. By 11 is denoted a first antenna composed of a horizontal part 12 and a vertical part 13 to form a T-shape. To one side of the vertical part 13 of the first antenna 11 is connected a second antenna 14 for phase compensation which is composed of one horizontal wire having the end portion thereof folded back over itself. To the other side of the vertical part 13 is connected a third antenna 15, for impedance matching, possessing a stub 21. A feed point 16 is connected to the third antenna 15.

Figure 16:
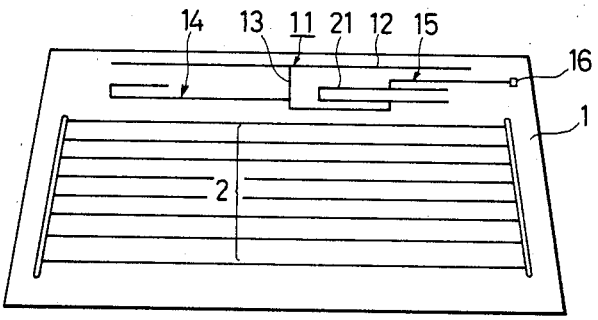
Figure 17:
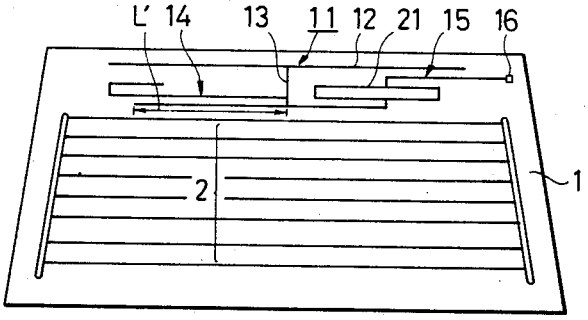

FIG. 16 and FIG. 17 illustrate window glass antennas representing the fifth and sixth embodiments of this invention. These are modifications of the fourth embodiment of the invention. In the diagrams, the same numerical symbols as those of FIG. 15 represent the same components as indicated in FIG. 15.

The window glass antenna of the fifth embodiment illustrated in FIG. 16 is a modification of the window glass antenna of the fourth embodiment in the respect that it has the stub 21 of the third antenna 15 kept open.

The window glass antenna of the sixth embodiment illustrated in FIG. 17 is a modification of the fourth embodiment in the respect that the second antenna 14 is composed of an antenna having one horizontl wire with the end portion thereof folded back and one straight antenna having an open end.

When the automotive window glass antennas of the fourth through sixth embodiments of this invention are to receive FM broadcasting waves, their respective T-shaped first antennas 11 function as main antennas throughout the entire FM fequency zone. In each of these window glass antennas, the second antenna 14 for phase compensation disposed on one side of the vertical part 13 of the first antenna 11 functions to eliminate phase difference between direct waves and indirect waves or waves reflected by the automobile body, the ground, buildings, human bodies, etc., improve the directional property, and heighten the average gain. The third antenna 15 for impedance matching which is disposed on the other side of the aforementioned vertical part 13 functions to approximate the impedance of the antenna to the impedance (75 Ω) of the feeder wire (coaxial cable) and heighten the receiving sensitivity and, through adjustment of the connecting position (tap) of the stub of the third antenna and the length of the main antenna, enhance the antenna gain and improve the frequency property.

Figure 18:
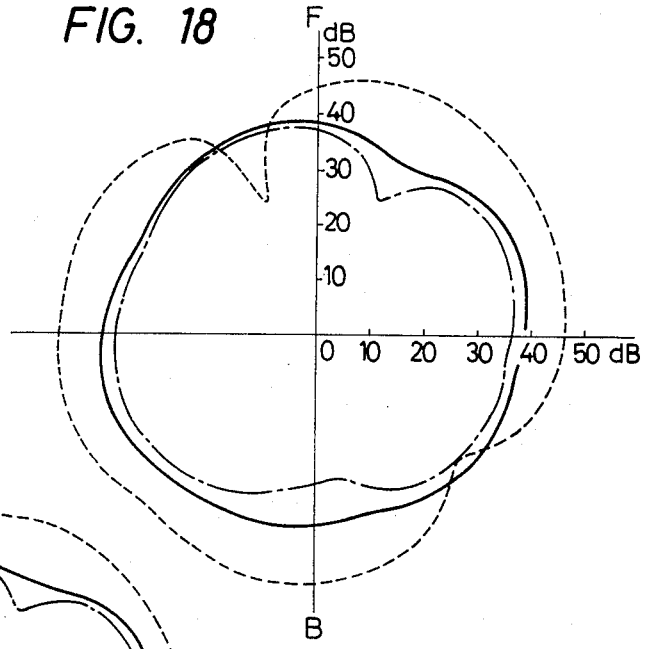
FIG. 18, FIG. 19, and FIG. 20 are diagrams of the directional property which the window glass antenna of the fourth embodiment mentioned above exhibits on receiving FM waves of 80 MHz, 83 MHz and 86 MHz respectively.
Figure 19:
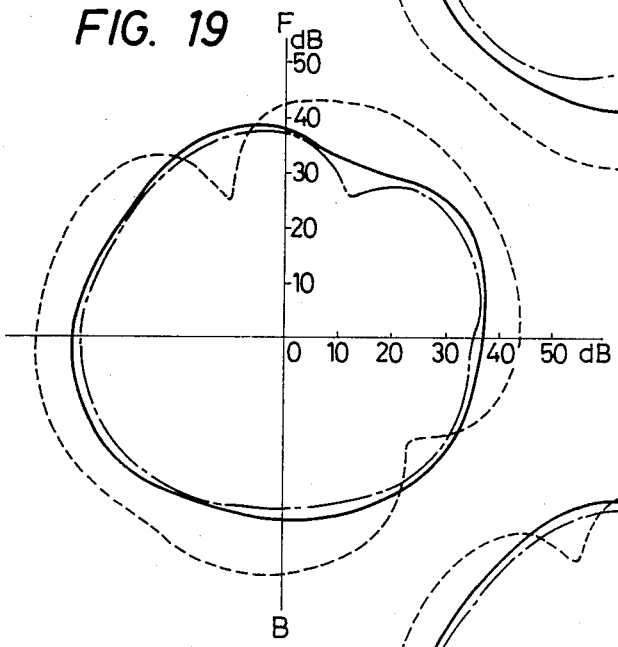
Figure 20:
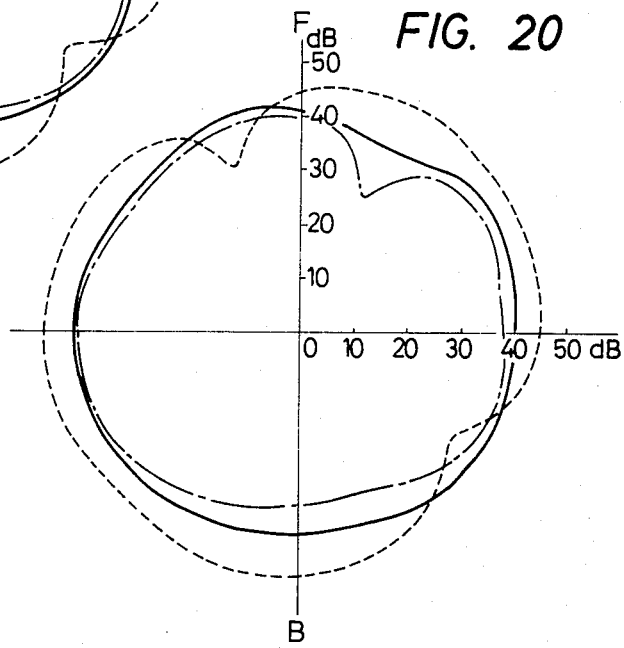

In the automotive window glass antenna of the fourth embodiment illustrated in FIG. 15, when the sheet glass 1 is formed in the dimensions, A=1,100 mm, A'=1,450 mm, and B=590 mm, and the component parts of the antenna wires are formed in the dimensions, M=520 mm, L=530 mm, 1=60 mm, d=10 mm, e=60 mm, f=30 mm, x=260 mm, y=500 mm, p=15 mm, q=15 mm, c=30 mm, g=30 mm, j=10 mm, k=20 mm, and h=40 mm, the directional property of the antenna is as shown in FIG. 18, FIG. 19, and FIG. 20.

FIG. 18 is the directional diagram in the FM zone at 80 MHz, FIG. 19 that at 83 MHz, and FIG. 20 that at 86 MHz respectively. In these diagrams, the solid line represents the directional property of the window glass antenna of the embodiment of FIG. 15, the dotted line that of a whip antenna 1 m in length, and the chain line that of the window glass antenna of FIG. 15 minus the second antenna 14.

From the solid lines in FIG. 18, FIG. 19, and FIG. 20, it is noted that the window glass antenna of the present embodiment exhibits a highly desirable directional property to waves arriving from all directions. It is also noted that the receiving gain of the window glass antenna of the present embodiment is fairly near that of the whip antenna.

The average gain in the FM zone of the window glass antenna of the fourth embodiment measured and expressed in terms of the gain difference based on the gain of the conventional window glass antenna of FIG. 1 taken as 0 dB is +5.3 dB at 80 MHz, +7.8 dB at 83 MHz, and +2.7 dB at 86 MHz respectively, averaging +5.3 dB. Even from this point of view, therefore, the window glass antenna of this embodiment exhibits notably high gain.

In the antenna pattern of the fourth embodiment minus the first antenna 11, namely a window glass antenna composed only of the second antenna 14 and the third antenna 15, the average gain in the FM zone measured and expressed in terms of the gain difference based on the gain of the window glass antenna of the fourth embodiment of FIG. 15 taken as 0 dB is −12.2 dB at 80 MHz, −12.5 dB at 83 MHz, and −9.8 dB at 86 MHz respectively, averaging −11.5 dB. The results indicate that the first antenna 11 contributes very much to improving the gain and, therefore, functions as a main antenna.

In the case of the antenna pattern of the aforementioned fourth embodiment minus the second antenna 14, namely a window glass antenna composed only of the first antenna 11 and the third antenna 15, the average gain measured similarly and expressed in terms of the gain difference based on the gain of the window glass antenna of the fourth embodiment taken as 0 dB is −1.1 dB at 80 MHz, −0.7 dB at 83 MHz, and −1.5 dB at 86 MHz respectively, averaging −1.1 dB and involving no appreciable difference. In the directional diagrams of FIG. 18, FIG. 19, and FIG. 20, the curves (chain line) representing the window glass antenna lacking the second antenna 14 show dips in gain. These dips are thought to result from phase difference between direct waves and indirect waves or waves reflected by the ground, the automobile body, etc. It is, accordingly, noted that the second antenna 14 of the present embodiment functions to eliminate such dips and contributes to improving the directional property.

In the case of the window glass antenna representing the fourth embodiment of the invention, when the third antenna 15 is replaced by a single conductor and one end of that conductor is connected to the vertical part 13 and the feed of power is made through the other end of the conductor, the average gain similarly measured and expressed in terms of the same gain difference as described above is −6.2 dB at 80 MHz, −9.9 dB at 83 MHz, and −5.3 dB at 86 MHz respectively, averaging −7.1 dB. The results indicate that the third antenna 15 contributes to improving the gain. In the case of the window glass antenna not lacking the third antenna 15, the impedance of the antenna measured at the feed point 16 (for comparison, the impedance measured in the window glass antenna lacking the third antenna 15, namely using a conductor instead, with the power fed solely through the conductor, is indicated in parentheses) is Rs (pure resistance component) =227 Ω (108 Ω) and Xs (reactance component; + being inductive and − capactive) = −61 Ω(+296 Ω) at 80 MHz, Rs =93 Ω(504 Ω) and Xs= −99 Ω(−486 Ω) at 83 MHz, and Rs =83 Ω(133 Ω) and Xs= −13 Ω(−241 Ω) at 86 MHz respectively. It is noted, therefore, that the pure resistance Rs is near 75 Ωand the reactance |Xs| is close to 0 Ω. The results indicate that the third antenna 15 functions to match the impedance stably throughout the entire FM frequency zone and enables the properties inherent in the antenna to be fully manifested.

In the case of the window glass antenna representing the fourth embodiment, when the dimensions of M, L, and x are fixed at 300 mm, 415 mm, and 320 mm respectively and the other component parts are formed in the same dimensions as described above, the average gain in the FM zone measured similarly and expressed in terms of the gain difference based on the gain of the rear whip antenna taken as 0 dB is −6.0 dB at 90 MHz, −6.1 dB at 100 MHz, and +7.7 dB at 108 MHz respectively, averaging −1.4 dB, with respect to horizontally polarized waves. The average gain, with respect to vertically polarized waves, is −13.1 dB at 90 MHz, −19.7 dB at 100 MHz, and −3.3 dB at 108 MHz respectively, averaging −12.0 dB.

In consideration of the fact that the conventional window glass antenna of good quality has average gains of about −5.7 dB and −20 dB with respect to horizontally polarized waves and vetically polarized waves respectively, it may be judged that the window glass antenna of the present embodiment exhibits very high average gains.

In the case of the window glass antenna representing the fifth embodiment of the invention which has substantially the same size as that of the fourth embodiment, the average gain in the FM zone similarly measured and expressed in terms of the gain difference based on the gain of the window glass antenna of the fourth embodiment taken as 0 dB is −0.6 dB at 80 MHz, −1.5 dB at 83 MHz, and +1.4 dB at 86 MHz respectively, averaging −0.2 dB. The results indicate that the properties of the window glass antenna of the fifth embodiment are equal to those of the window glass antenna of the fourth embodiment.

In the case of the window glass antenna of the sixth embodiment of this invention illustrated in FIG. 17, when the length, L', of the antenna wire having an open end is fixed at 500 mm and the othe components (both glass and antenna) are formed in the same dimensions as those of the fourth embodiment, the average gain similarly measured and expressed in terms of the gain difference based on the gain of the window glass antenna of the fourth embodiment taken as 0 dB is −0.7 dB at 80 MHz, +1.8 dB at 83 MHz, and +0.4 dB at 86 MHz respectively, averaging +0.5 dB. The results indicate that the properties exhibited by the window glass antenna of the sixth embodiment are equal to or better than those of the window glass antenna of the fourth embodiment.

The window glass antennas representing the fourth through sixth embodiments of the present invention described above admit of the following alterations in antenna pattern.

(1) The T-shaped main antennas may be modified in much the same way as those in the first through third embodiments described above.

(2) The number of horizontal wires of the second antenna 14 is not necessarily limited to one as illustrated in FIG. 15 but may be two or even more as illustrated in FIG. 17. Even when two or more horizontal wires are used, the properties exhibited by the window glass antenna are substantially equal to those of the window glass antenna of the fourth embodiment.

Figure 21:
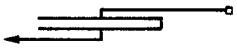
FIGS. 21–25 are plan views of modifications of the third antenna wires in the window glass antennas respectively of the fourth through sixth embodiments.
Figure 22:
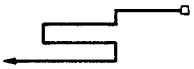
Figure 23:
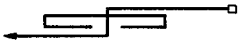
Figure 24:
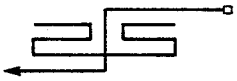
Figure 25:
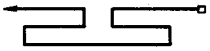
Figure 26:
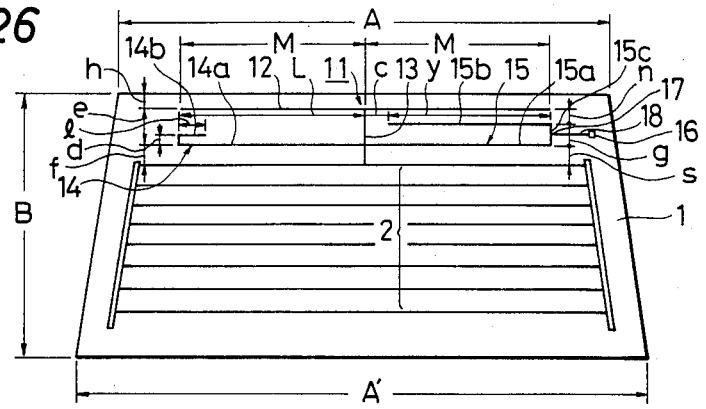
FIG. 26, FIG. 27, and FIG. 28 are plan views of window glass antennas representing the seventh, eighth, and ninth embodiments of this invention.
Figure 27:
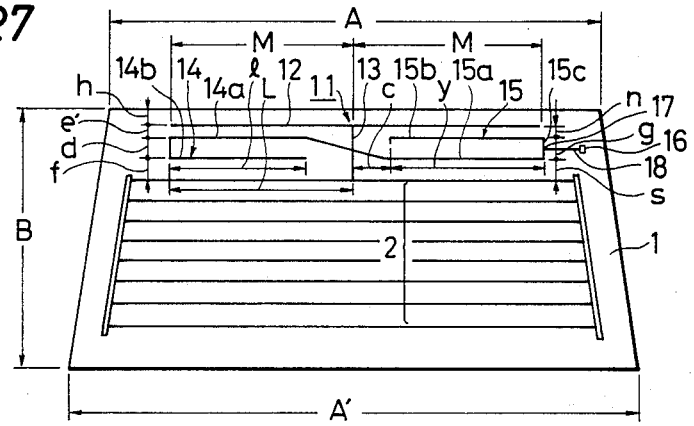
Figure 28:
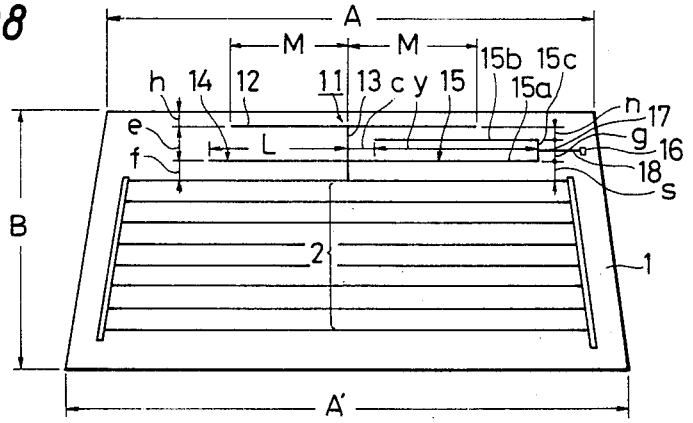

(3) The third antenna 15 may be in the shape of a stub as illustrated in FIG. 21 and FIG. 22. Otherwise, it may be in any of the shapes illustrated in FIG. 23, FIG. 24, and FIG. 25. FIG. 26, FIG. 27, and FIG. 28 illustrate window glass antennas representing the seventh, eighth, and ninth embodiments of the present invention. In these diagrams, the numerical symbols which correspond to those of FIGS. 6–8 represent the same components as indicated in FIGS. 6–8.

These window glass antennas belong to the second type mentioned previously. They are respective modifications of the window glass antennas of the first, second, and third embodiments in the respect that they have heat wires and antenna wires connected to each other and use the heat wires concurrently as auxilliary antenna wires.

Figure 29:
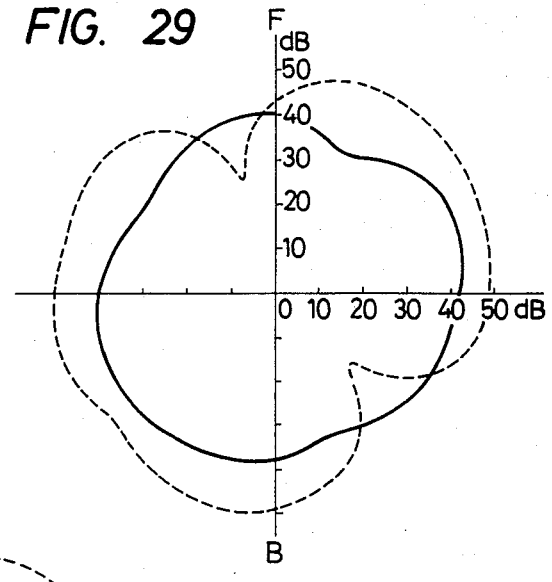
FIG. 29, FIG. 30, and FIG. 31 are diagrams of the directional property which the window glass antenna of the seventh embodiment mentioned above exhibits on receiving FM waves of 80 MHz, 83 MHz, and 86 MHz respectively.
Figure 30:
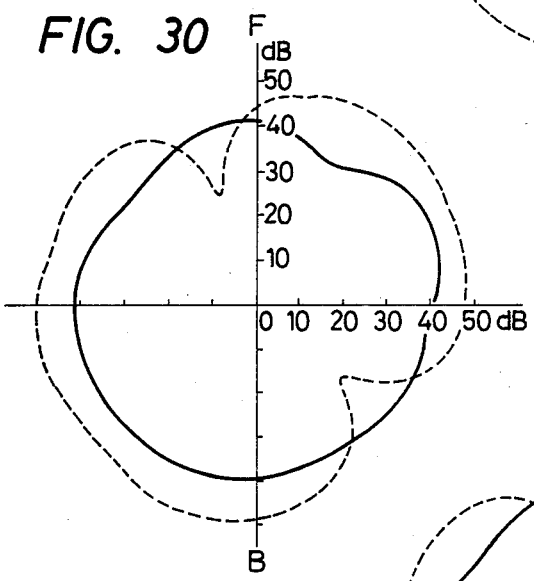
Figure 31:
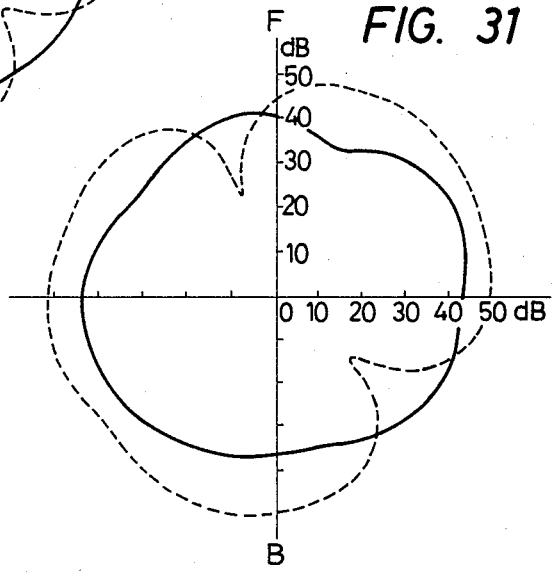

Specifically, the seventh embodiment of FIG. 26 modifies the first embodiment of FIG. 6 by extending the vertical part 13 of the first antenna 11 downwardly and connecting the extended vertical part 13 to the heat wires 2. The eighth embodiment of FIG. 27 modifies the second embodiment of FIG. 7 by extending the vertical part 13 of the first antenna 11 downwardly and connecting it to the heat wire 2. And the ninth embodiment of FIG. 28 modifies the third embodiment of FIG. 8 by extending the vertical part 13 of the first antenna 11 and connecting it to the heat wire 2. In the automotive window glass antenna of the seventh embodiment of FIG. 26, when the component parts are formed in the dimensions, A=1,100 mm, A'=1,450 mm, B=590 mm, M=510 mm, L=520 mm, l=40 mm, d=10 mm, e=60 mm, f=30 mm, y=500 mm, s=30 mm, c=20 mm, g =30 mm, n=30 mm, and h=40 mm, and the heater wiring 2 is composed of 13 wires spaced by intervals of 35 mm, the directional property of antenna is as shown in FIG. 29, FIG. 30, and FIG. 31. In these diagrams, FIG. 29 represents the directional property at 80 1 MHz, FIG. 30 that at 83 MHz, and FIG. 31 that at 86 MHz respectively, with repsect to horizontally polarized waves in the FM zone. The solid lines represent the directional property of the window glass antenna of the eighth embodiment, and the dotted lines represent the directional property of the whip antenna 1 m in length From the solid lines of FIG. 29, FIG. 30, and FIG. 31, it is noted that the window glass antenna of the present embodiment exhibits highly desirable isotropy to waves arriving from all directions. It is also noted that the receiving gain of the window glass antenna of the present embodiment approximates that of the whip antenna shown in FIG. 29, FIG. 30, and FIG. 31.

The average gain of the window glass antenna of the present embodiment measured with repsect to horizontally polarized waves in the FM zone and expressed in terms of the gain difference based on the gain of the rear whip antenna 1 m in length is −7.0 dB at 80 MHz, −5.9 dB at 83 MHz, and −6.0 dB at 83 MHz respectively, averaging −6.3 dB. In consideration of the fact that the conventional window glass antenna of good quality exhibits average gain of about −8 dB, it is judged that the window glass antenna of the present embodiment exhibits very high gain.

The window glass antenna of the seventh embodiment shows substantially no dip in the directional property as compared with that of the conventional window glass antenna illustrated in FIG. 4. This means that the seventh embodiment warrants notable improvement in the directional property.

In the case of the window glass antenna illustrated in FIG. 5 made for recognition the effect of this invention, when the component parts are formed in the dimensions, A=1,100 mm, A'=1,450 mm, B=590 mm, M=510 mm, L=520 mm, l=500 mm, f=30 mm, d=30 mm, e'=30 mm, and h=40 mm, the average gain with respect to horizontally polarized waves in the FM zone as measured similarly and expressed in terms of the gain difference based on the gain of the window glass antenna of the seventh embodiment of FIG. 26 taken as 0 dB is −8.0 dB at 80 MHz, −7.2 dB at 83 MHz, and −2.2 dB at 86 MHz respectively, averaging −5.8 dB. The results testify the desirability of forming the second and third antennas asymmetrically with respect to the vertical part of the first antenna as in the present embodiment.

In the window glass antenna of the eighth embodiment illustrated in FIG. 27, when the component parts thereof are formed in the dimensions, A=1,100 mm, A'=1,450 mm, B=590 mm, M=520 mm, L=540 mm, l=y=420 mm, d=g =30 mm, e'=n=30 mm, f=S=20 mm, c=100 mm, and h =40 mm, and the heater wiring 12 is composed of 13 heat wires spaced by intervals of 35 mm, the average gain with respect to horizontally polarized waves as measured similarly and expressed in terms of the gain difference based on the gain of the rear whip antenna 1 m in length is −8.7 dB at 80 MHz, −6.7 dB at 83 MHz, and −5.6 dB at 86 MHz respectively, averaging −7.0 dB. The results indicate that the properties exhibited by the window glass antenna of the eighth embodiment are equal to those of the window glass antenna of the seventh embodiment.

The window glass antenna of the ninth embodiment illustrated in FIG. 28 is particularly suited for the reception of FM broadcasting waves in the United States of America and Europe. Since the window glass antenna of the present embodiment is designed for a high frequency zone of 88 MHz to 108 MHz, the horizontal part 12 of the first antenna 11 has a smaller length than one in the said seventh embodiment and the second antenna 14, the length of which is relatively small, is composed solely of a horizontal part with its ends not folded back as compared with the window glass antenna of the seventh embodiment. The other component parts are formed in substantially the same dimensions and shapes.

In the case of the window glass antenna of the ninth embodiment illustrated in FIG. 28, when the component parts thereof are formed in the dimensions, M=320 mm, L=410 mm, e=60 mm, f=30 mm, y=500 mm, s=30 mm, c=20 mm, g=30 mm, n=30 mm, and h=40 mm, and the heater wiring 2 is formed of 13 heat wires spaced by intervals of 35 mm, the average gain with respect to vertically polarized waves in the FM zone as measured similarly and expressed in terms of the gain difference based on the gain of the rear whip antenna 1 m in length is −13.5 dB at 90 MHz, −17.5 dB at 100 MHz, and −4.6 dB at 108 MHz respectively, averaging −13.5 dB.

In the case of the same window glass antenna having the component parts thereof formed in entirely the same dimensions and shapes as described above, the average gain with respect to horizontally polarized waves in the FM zone as measured similarly and expressed in terms of the gain difference based on the gain of the rear whip antenna 1 m in length taken as 0 dB is −3.2 dB at 90 MHz, −3.3 dB at 100 MHz, and −1.1 dB and 108 MHz respectively, averaging −2.5 dB. In consideration of the fact that the conventional window glass antenna of good quality exhibits average gains of about −5.7 dB and −20 dB with respect to horizontally polarized waves and vertically polarized waves in the frequency zone of 88 MHz to 108 MHz prevalent in the United States of America and Europe, it is judged that the window glass antenna of the present embodiment is particularly suited for receiving FM broadcasts in the U.S.A. and Europe.

Furthermore, in the window glass antenna of this embodiment, the average gain with respect to vertically polarized waves as measured similarly and expressed in terms of the gain difference based on the gain of the window glass antenna of the seventh embodiment taken as 0 dB is +0.6 dB at 90 MHz, +8.7 dB at 100 MHz, and +13.2 dB at 108 MHz respectively, averaging +7.5 dB. The results also indicate that the window glass antenna of the present embodiment is particularly suited for the reception of FM waves of 88 MHz to 108 MHz.

The seventh through ninth embodiments described above admit of the same alterations in antenna pattern as described in (1) through (3) above with respect to the first through third embodiments.

FIG. 32, FIG. 33, FIG. 34, and FIG. 35 illustrate window glass antennas representing the 10th, 11th, 12th, and 13th embodiments of the present invention. In these diagrams, the same numerical symbols as those of FIG. 15 and FIG. 16 denote the same components as indicated in FIG. 15 and FIG. 16. The window glass antennas of these embodiments belong to the second type. The window glass antennas of the 10th and 11th embodiments are modifications respectively of those of the fourth and fifth embodiments in the respect that heat wires and antenna wires are connected to each other and the heat wires are concurrently used as auxiliary antenna wires.

Figure 32:
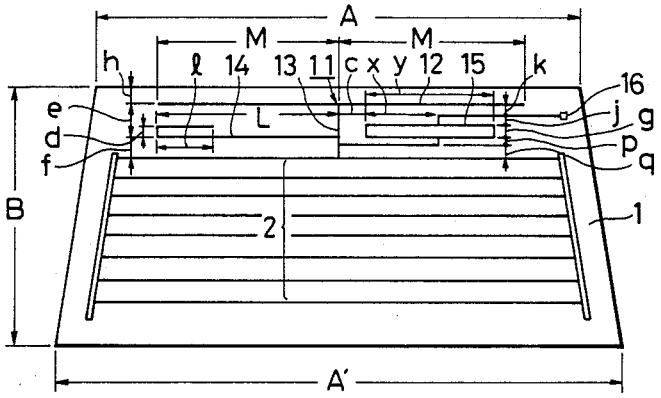
FIG. 32, FIG. 33, FIG. 34, and FIG. 35 are plan views of window glass antennas representing the 10th, 11th, 12th, and 13th embodiments of this invention.
Figure 33:
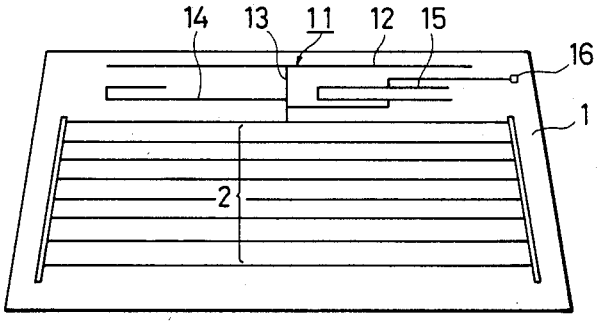

To be more specific, the window glass antennas of the 10th and 11th embodiments illustrated in FIG. 32 and FIG. 33 modify those of the fourth and fifth embodiments by extending the vertical parts of the first antennas 11 downwardly and connecting them to the heat wires 2.

Figure 34:
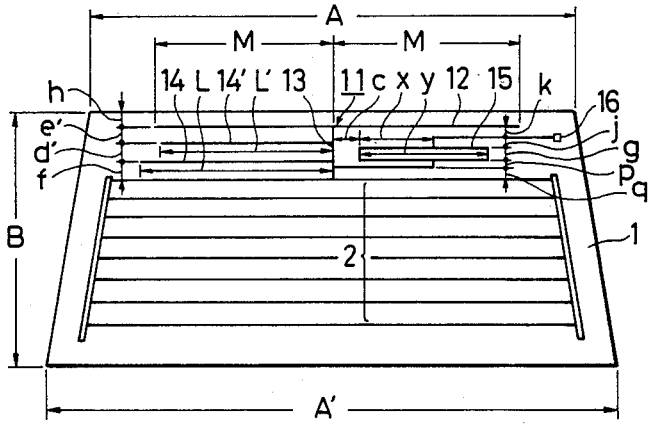

The window glass antenna of the 12th embodiment illustrated in FIG. 34 is a modification of that of the 10th embodiment in respect that the second antenna 14 is replaced by two antennas containing no folded part. The window glass antenna of the 13th embodiment illustrated in FIG. 35 has the second antenna 14 replaced by one relatively short horizontal antenna part having an open end thereof unfolded.

Figure 36:
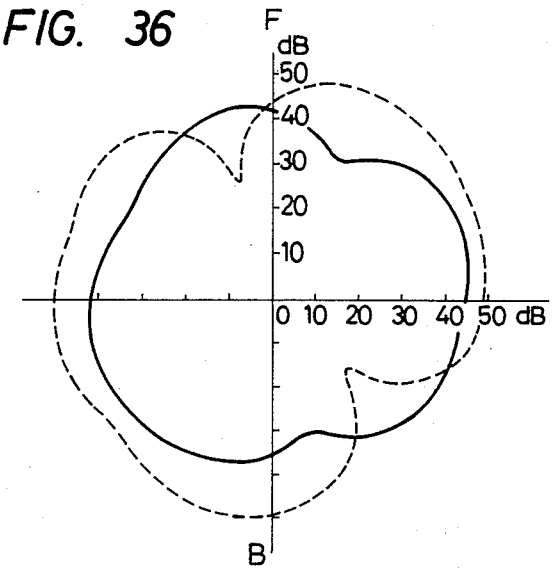
FIG. 36, FIG. 37, and FIG. 38 are diagrams of the directional property which the window glass antenna of the 10th embodiment mentioned above exhibits on receiving FM waves of 80 MHz, 83 MHz, and 86 MHz respectively.
Figure 37:
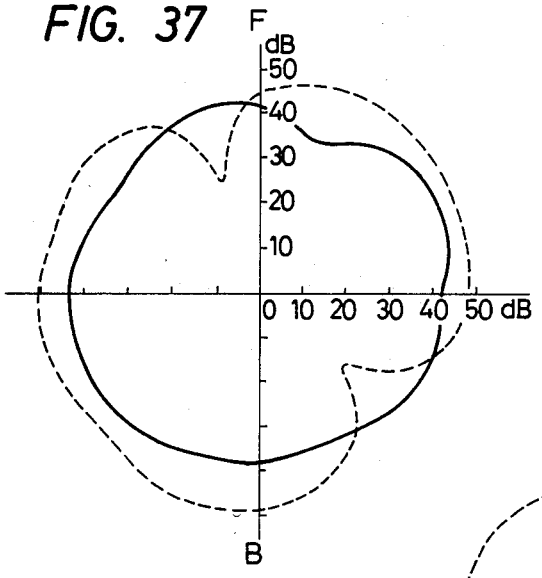
Figure 38:
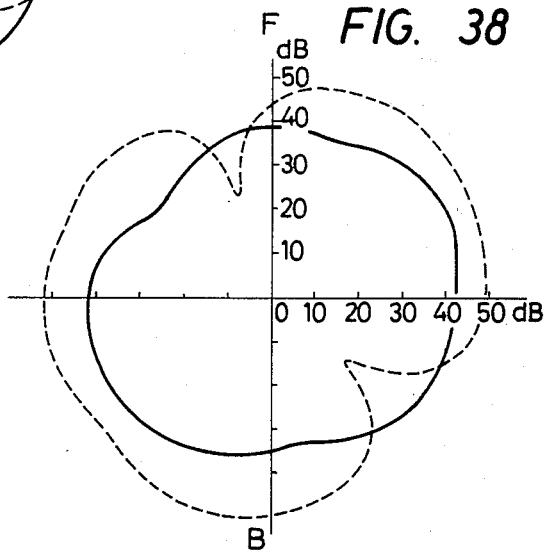

In the case of the automotive window glass antenna of the 10th embodiment illustrated in FIG. 32, when the sheet glass 1 is formed in the dimensions, A=1,100 mm, A'=1,450 mm, and B=590 mm, the components of the antenna wires are formed in the dimensions, M=510 mm, L=520 mm, l=160 mm, d=10 mm, e=60 mm, f=30 mm, x=320 mm, y =500 mm, p=15 mm, q=15 mm, c=30 mm, g=30 mm, j=10 mm, k=20 mm, and h=40 mm, and the heater wiring 2 is formed of 13 heat wires spaced by intervals of 35 mm, the directional property in the FM zone is as shown in FIG. 36, FIG. 37, and FIG. 38.

In these diagrams, FIG. 36 represents the directional property at 80 MHz, FIG. 37 that at 83 MHz, and FIG. 38 that at 86 MHz respectively with respect to horizontally polarized waves in the FM zone. The solid lines represent the directional property of the window glass antenna of the 10th embodiment, and the dotted lines represent the directional property of the whip antenna 1 m in length.

It is noted from FIG. 36, FIG. 37, and FIG. 38 that the window glass antenna of the present embodiment exhibits a highly desirable directional property to waves arriving from all directions. It is also noted that the receiving gain of the present embodiment is near that of the whip antenna illustrated in FIG. 36, FIG. 37, and FIG. 38.

In the case of the window glass antenna of the present embodiment, the average gain expressed in terms of the gain difference based on the gain of the rear whip antenna 1 m in length taken as 0 dB is −5.5 dB at 80 MHz, −4.7 dB at 83 MHz, and −7.4 dB at 86 MHz respectively, averaging −5.8 dB. In contrast, the average gain exhibited by the conventional window glass antenna of good quality is about −8 dB. Thus, it is judged that the average gain of the window glass antenna of the present embodiment is near that of the whip antenna and, therefore, is very high as compared with that of the conventional window glass antenna.

The window glass antenna of the 11th embodiment illustrated in FIG. 33 is a modification of that of the 10th embodiment in the respect that the stub of the impedance matching antenna is kept open. Except for this alteration, the antenna pattern and the dimensions of the component parts are substantially equal to those of the window glass antenna of the 10th embodiment.

In the case of this window glass antenna, the average gain with respect to horizontally polarized waves in the FM zone similarly measured and expressed in terms of the gain difference based on the gain of the rear whip antenna 1 m in length taken as 0 dB is −7.0 dB at 80 MHz, −4.2 dB at 83 MHz, and −3.8 dB at 86 MHz respectively, averaging −5.6 dB. Thus, it is noted that the properties of this window glass antenna are similar to that of the 10th embodiment described above.

In the case of the window glass antenna of the 12th embodiment, when the component parts thereof are formed in the dimensions, A=1,100 mm, A'=1,450 mm, B=590 mm, M=520 mm, L=530 mm, L'=510 mm, d'=30 mm, e'=30 mm, x=320 mm, y=500 mm, p=15 mm, q=15 mm, c=30 mm, g=30 mm, j=10 mm, k=20 mm, and h=40 mm, and the heater wiring is laid out under the same conditions as in the 10th embodiment, the average gain with respect to horizontally polarized waves in the FM zone as measured similarly and expressed in terms of the gain difference based on the gain of the rear whip antenna 1 m in length taken as 0 dB is −7.5 dB at 80 MHz, −5.5 dB at 83 MHz, and −8.2 dB at 86 MHz respectively, averaging −7.1 dB. Thus, it is noted that the properties of the window glass antenna of this embodiment are substantially equal to those of the windown glass antennas of the 10th and 11th embodiments described above.

Figure 35:
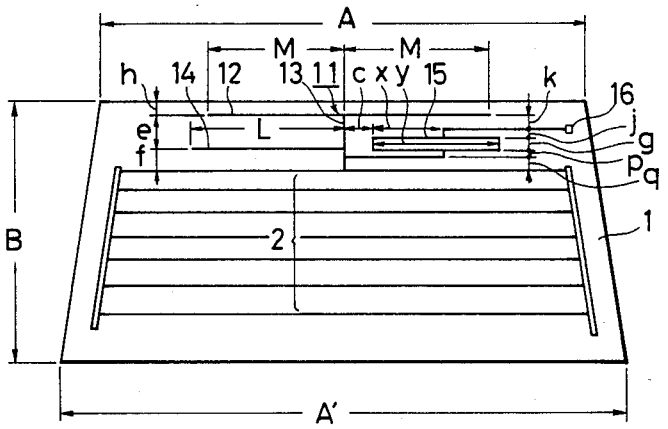

The window glass antenna of the 13th embodiment illustrated in FIG. 35 is particularly suited for the reception of FM broadcasting waves used prevalently in the United States of America and in Europe. As the window glass antenna of this embodiment is designed for a high frequency zone of 88 MHz to 108 MHz, the first antenna 11 has the horizontal part 12 thereof formed in a smaller length than one in the said 10th embodiment and the second antenna 14, the length of which is relatively small, is formed solely of a horizontal part having an open end thereof left unfolded. Except for these alterations, the antenna pattern and the dimensions of the component parts are practically the same.

In the case of the window glass antenna of the 13th embodiment, when the component parts are formed in the dimensions, A=1,100 mm, A'=1,450 mm, B=590 mm, M=300 mm, L=415 mm, e=60 mm, f=30 mm, x=320 mm, y=500 mm, p=15 mm, q=15 mm, c=30 mm, g=30 mm, j=10 mm, K=20 mm, and h=40 mm, and the heater wiring is formed of 13 heat wires spaced by intervals of 35 mm, the average gains with respect to vertically polarized waves and horizontally polarized waves in the FM zone as measured similarly and expressed in terms of the gain difference based on the gain of the rear whip antenna 1 m in length taken as 0 dB are −18.9 dB and −4.5 dB at 90 MHz, −15.8 dB and −4.7 dB at 100 MHz, and −7.9 dB and +8.0 dB at 108 MHz respectively, averaging −14.2 dB and −0.4 dB. In consideration of the fact that the conventional window glass antenna of good quality has average gains of about −20 dB and −5.7 dB for vertically polarized waves and horizontally polarized waves, it is judged that the average gains of the window glass antenna of the present embodiment are very high.

The average gain actually measured of the window glass antenna of the present embodiment with respect to vertically polarized waves in the FM zone, as expressed in terms of the gain difference based on the gain of the window glass antenna of the 10th embodiment taken as 0 dB, is −5.8 dB at 90 MHz, +19.3 dB at 100 MHz, and +3.9 dB at 108 MHz respectively, averaging +5.8 dB. The results indicate that the window glass antenna of the present embodiment is suited for the reception of vertically polarized FM waves of 88 to 108 MHz.

The 10th through 13th embodiments described above admit of the same alterations of antenna pattern as described in (1) through (3) with reference to the fourth through sixth embodiments.

In the foregoing description of the first through 13th embodiments, the effects of the individual embodiments have been illustrated by assigning specific dimensions to the component parts of antenna wires and then enumerating the results of actual measurement of antenna properties. Naturally, the optimum magnitudes of the dimensions of such component parts of antenna wires vary with the kind of automobile (opening, angle of fixation of glass, length of feeder, place of distribution of feeder, etc.).

In the reception of FM waves of 76 MHz to 90 MHz, the length, M, of the horizontal part 12 which chiefly functions as a main antenna can be varied in the range of $(\lambda/4)\alpha \pm (\lambda/20)\alpha$, (wherein $\alpha$ denotes the wavelength reduction ratio of the window glass antenna, which is about 0.7) where the wavelength of the FM broadcasting frequency is denoted by $\lambda$, namely, in the range of 450 to 850 mm.

The length, L, of the second phase compensation antenna 14, similarly to M, can be varied in the range of $(\lambda/4)\alpha \pm (\lambda/20)\alpha$, namely, in the range of 450 to 850 mm.

The dimension, y, of the third impedance matching antenna 15 can be varied in the range of $[(\lambda/8)\alpha - (\lambda/20)\alpha]$ to $[(\lambda/4)\alpha + (\lambda/20)\alpha]$, namely, in the range of 200 to 850 mm.

The folded part **14*b* of the second antenna 14** is effective in increasing the capacity and decreasing the change in impedance over a wide zone. When the length L happens to equal the length of resonance, however, omission of this folded part proves rather desirable because the value of Q ($=1/\omega CR$) and consequently the gain is increased. Otherwise, the folding may be effected below the upper limit of 300 mm.

As regards the lengths d, e, e', f, s, p, q, c, g, n, j, k and h, each of their optimum values may be selected at least 3 mm so as to reduce the stray capacity between the parallel elements.

The window glass antenna of each of the embodiments of this invention described above can be formed by printing the relevant antenna pattern with a conductive paste and firing the printed pattern of the paste or by embedding a thin metal wire in the antenna pattern in a laminated window glass.

Since the window glass antenna of each of the embodiments of this invention amply makes up for dips in gain of the whip antenna, it can be utilized advantageously as a window glass antenna part of the so-called diversity reception antenna which combines a whip antenna and a window glass antenna in a manner enabling the two antennas to be freely switched from one to the other depending on the optimum condition of reception.

As described above, the window glass antenna of this invention is highly effective in improving the directional property and notably enhancing the average gain throughout the entire FM frequency zone and also heightening the average gain with respect to vertically and horizontally polarized waves in the FM zone as compared with the conventional window glass antenna.

What is claimed is:

1. An automotive window glass antenna having an antenna formed on a window glass pane of an automobile, said window glass antenna having an antenna pattern comprising in combination a first main antenna possessing a horizontal part and a vertical part to form a T-shape, a second antenna for phase compensation formed of at least one horizontal antenna wire disposed on one side of said vertical part of said first antenna and connected thereto, a third antenna for impedance matching disposed on the other side of said vertical part of said first antenna and connected thereto, said third antenna comprising a first horizontal element one end of which is connected to said vertical part of said first antenna, a vertical element one end of which is connected to the other end of said first horizontal element, said vertical element of said third antenna extending from the other end of said horizontal element toward the horizontal part of said first antenna in a direction generally parallel to the vertical part of said first antenna, and said third antenna further including a second horizontal element extending from the other end of said vertical element toward the vertical part of said first antenna in a direction substantially parallel to the horizontal part of said first antenna, the length of said vertical element of said third antenna being less than the distance along said vertical part of said first antenna between said horizontal part of said first antenna and said first horizontal element of said third antenna, and a feed point connected to said vertical element of said third antenna, said second and third antennas being asymmetric with respect to the vertical part of the first antenna.

2. An automotive window glass antenna according to claim 1 wherein said window glass pane includes heating wires, said vertical part of said first antenna being extended and connected to said heating wires whereby said heating wires concurrently act as a receiving antenna.

3. An automotive window glass antenna according to claim 1 or claim 2 wherein said second antenna for phase compensation possesses a first horizontal part, a second horizontal part parallel to and spaced from said first horizontal part, and a vertical part interconnecting said two horizontal parts.

4. An automotive window glass antenna according to claim 1 or claim 2 wherein half of the length of the horizontal part of said first antenna is $(\lambda/4)\alpha \pm (\lambda/20)\alpha$ where $\lambda$ is the wavelength of an FM frequency to be received and $\alpha$ is the wavelength reduction ratio of the window glass antenna.

5. An automotive window glass antenna according to claim 1 or 2 wherein the length of said second horizontal element of said third antenna is $(\lambda/4)\alpha \pm (\lambda/20)\alpha$ where $\lambda$ is the wavelength of an FM frequency to be received and $\alpha$ is the wavelength reduction ratio of the window glass antenna.

6. An automotive window glass antenna having an antenna formed on a window glass pane of an automobile, said window glass antenna having an antenna pattern comprising in combination a first main antenna possessing a horizontal part and a vertical part to form a T-shape, a second antenna for phase compensation formed of at least one horizontal antenna wire disposed on one side of the vertical part of said first antenna and connected thereto, a third antenna for impedance matching having a horizontal element connected to the other side of the vertical part of said first antenna and a stub connected to the end of said horizontal element remote from said vertical part of said first antenna, said stub comprising at least two parallel elements and at least one further element extending transverse to said two parallel elements to connect them to one another, and a feed point connected to said stub of said third antenna, said third antenna being positioned on the side of said vertical part of said first antenna opposite to said second antenna and being so disposed that said stub of said third antenna does not protrude beyond either of the opposing ends of the vertical part of said first antenna and is located between said horizontal element of the third antenna and the horizontal part of said first antenna.

7. The automotibe window glass antenna of claim 6 wherein said stub has a closed rectangular configuration.

8. The automotive window glass antenna of claim 6 wherein said stub has a U-shaped configuration.

9. The automotive window glass antenna of claim 6 wherein the window glass pane includes heating wires, said vertical part of said first antenna being extended and connected to said heating wires so that said heating wires can be used concurrently as a receiving antenna.

10. The automotive window glass antenna of one of claims 6–9 wherein said second antenna for phase compensation includes first and second horizontal elements disposed in spaced parallel relation to one another, and a vertical element interconnecting said first and second horizontal elements at a location spaced from the vertical part of said first antenna.

11. The automobile window glass antenna of one of claims 6–9 wherein half of the length of the horizontal part of said first antenna is $(\lambda/4)\alpha \pm (\lambda/20)\alpha$, where $\lambda$ is the wavelength of an FM frequency to be received and $\alpha$ is the wavelength reduction ratio of the window glass antenna.

12. The automotive window glass antenna of one of claims 6–9 wherein the length of the parallel elements of said stub is within the range of $\{(\lambda/8)\alpha-(\lambda/20)\alpha\}$ to $\{(\lambda/4)\alpha+(\lambda/20)\alpha\}$, where $\lambda$ is the wavelength of an FM frequency to be received and $\alpha$ is the wavelength reduction ratio of the window glass antenna.

13. An automotive window glass antenna having an antenna formed on a window glass pane of an automobile, said window glass antenna having an antenna pattern comprising in combination a first main antenna possessing a horizontal part and a vertical part to form a T-shape, a second antenna operative to effect phase compensation, said second antenna being disposed on one side of said vertical part of said first antenna and connected thereto, a third antenna operative to effect impedance matching, said third antenna being disposed on the other side of said vertical part of said first antenna and connected thereto, said third antenna comprising a horizontal element one end of which is connected to said vertical part of said first antenna and the other end of which is connected to an additional element which is positioned between said horizontal part of said first antenna and said horizontal element of said third antenna, said additional element including at least one vertical part which is located between said horizontal part of said first antenna and said horizontal element of said third antenna and which is spaced from and extends parallel to said vertical part of said first antenna, the length of said vertical part of said additional element being less than the distance along said vertical part of said first antenna between said horizontal part of said first antenna and said horizontal element of said third antenna, and a feed point connected to said additional element of said third antenna for connection via said additional element to each of said third, second and first antennas, said second and third antennas being asymmetric with respect to the vertical part of the first antenna.

14. The automotive window glass antenna of claim 13 wherein said additional element of said third antenna is a stub.

* * * * *